US006015516A

United States Patent [19]

Chung et al.

[11] Patent Number: 6,015,516

[45] Date of Patent: Jan. 18, 2000

[54] ULTRATHIN HIGH-PERFORMANCE HOLLOW FIBER MEMBRANES

[75] Inventors: Tai-Shung Chung, Ann Arbor, Mich.; Xudong Hu; Soo Khean Teoh, both of Singapore, Singapore

[73] Assignee: National University of Singapore, Singapore

[21] Appl. No.: 09/100,094

[22] Filed: Jun. 19, 1998

[30] Foreign Application Priority Data

Jun. 16, 1998 [SG] Singapore ..... 9801427-7

[51] Int. Cl.[7] ..... D01D 5/247

[52] U.S. Cl. ..... 264/41; 264/129; 264/178 F; 264/184; 264/209.1; 264/211.14; 264/211.16; 264/559; 264/561; 264/562; 264/563; 427/245

[58] Field of Search ..... 264/41, 129, 178 F, 264/184, 209.1, 211.14, 211.16, 559, 561, 562, 563; 427/245

[56] References Cited

U.S. PATENT DOCUMENTS 4,871,494 10/1989 Kesting et al. .
4,902,422 2/1990 Pinnau et al. .
5,209,883 5/1993 Chung et al. .

OTHER PUBLICATIONS

Tai–Shung Chung et al., *Journal of Membrane Science,* vol. 75, pp. 181–195 (1992).
Tai–Shung Chung et al., *Journal of Membrane Science,* vol. 88, pp. 21–36 (1994).
Tai–Shung Chung et al., *Journal of Membrane Science,* vol. 133, pp. 161–175 (1997).
Dongliang Wang et al., *Journal of Membrane Science,* vol. 98, pp. 233–240 (1995).
Dongliang Wang et al., *Journal of Membrane Science,* vol. 105, pp. 89–101 (1995).
Y. S. Chen et al., *Chemical Engineering Research and Design,* vol. 73, No. A5, pp. 567–574 (1995).
Dongliang Wang et al., *Journal of Membrane Science,* vol. 115, pp. 85–108 (1996).
K. Li et al., *Chemical Engineering Research and Design,* vol. 74, No. A8, pp. 856–862 (1996).
Dongliang Wang et al., *The Polymer Processing Society,* pp. 92–93 (undated).

*Primary Examiner*—Leo B. Tentoni
*Attorney, Agent, or Firm*—Birch, Stewart, Kolasch & Birch, LLP

[57] ABSTRACT

A process for forming ultrathin dense-layer asymmetric hollow fiber membranes with a dense layer of less than 500 Å from a binary solution system comprising a polymer and a solvent. In this process, the spinning polymeric solution has a high viscosity and exhibits chain entanglement at the spinning temperature. The solubility parameter difference between the bore fluid and the spinning dope is less than 2.5 $(cal/cm^3)^{0.5}$ and the volume ratio of bore-fluid flow rate to the dope flow rate is between 0.45 to 0.75. The dope is wet-spun into hollow fibers using water as external coagulant. The ultrathin dense-layer asymmetric hollow fiber membranes are suitable for air and other gas separations.

13 Claims, 6 Drawing Sheets

The Schematic Diagram of The Hollow Fiber Spinning Process

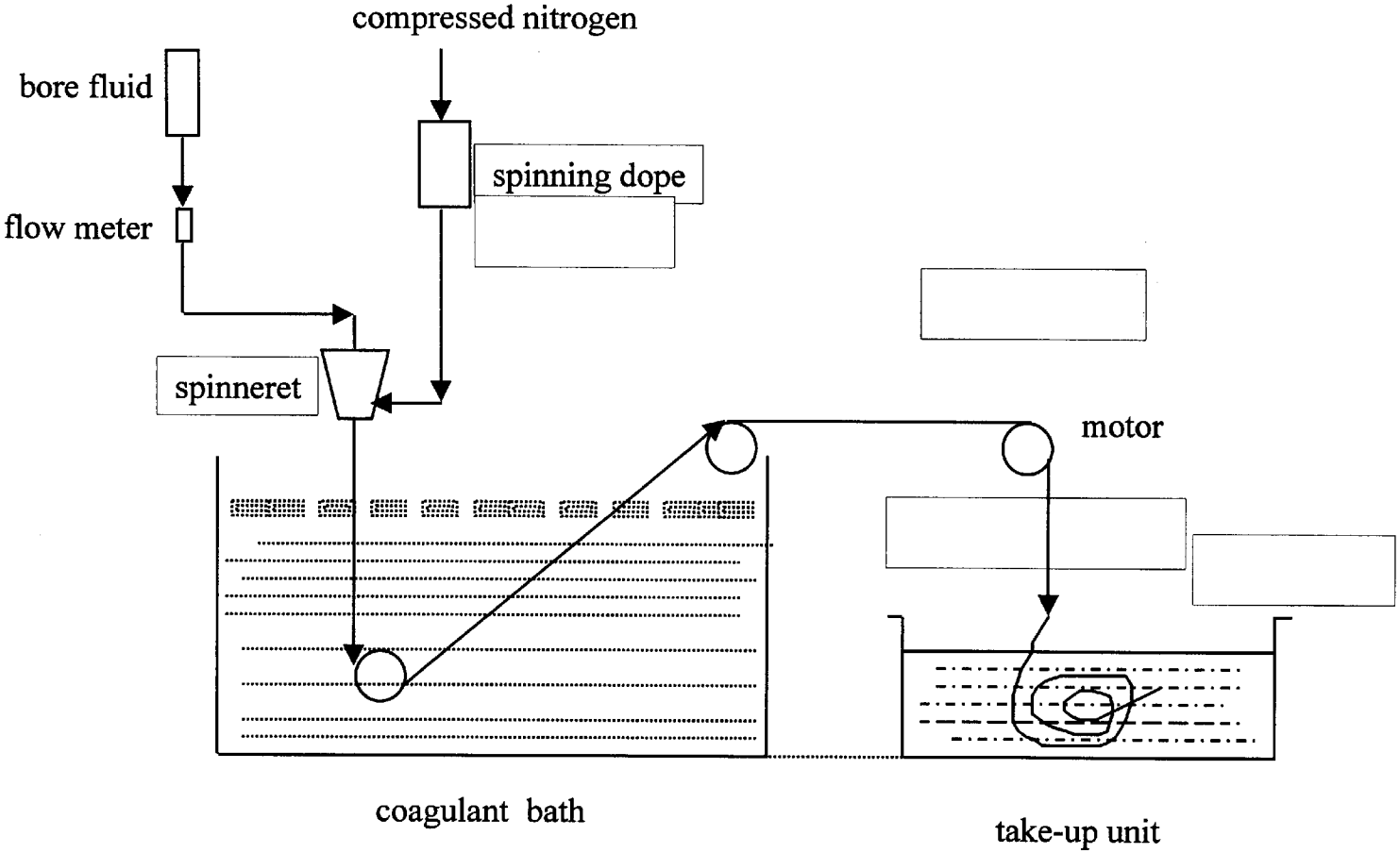
Figure 1 The Schematic Diagram of The Hollow Fiber Spinning Process

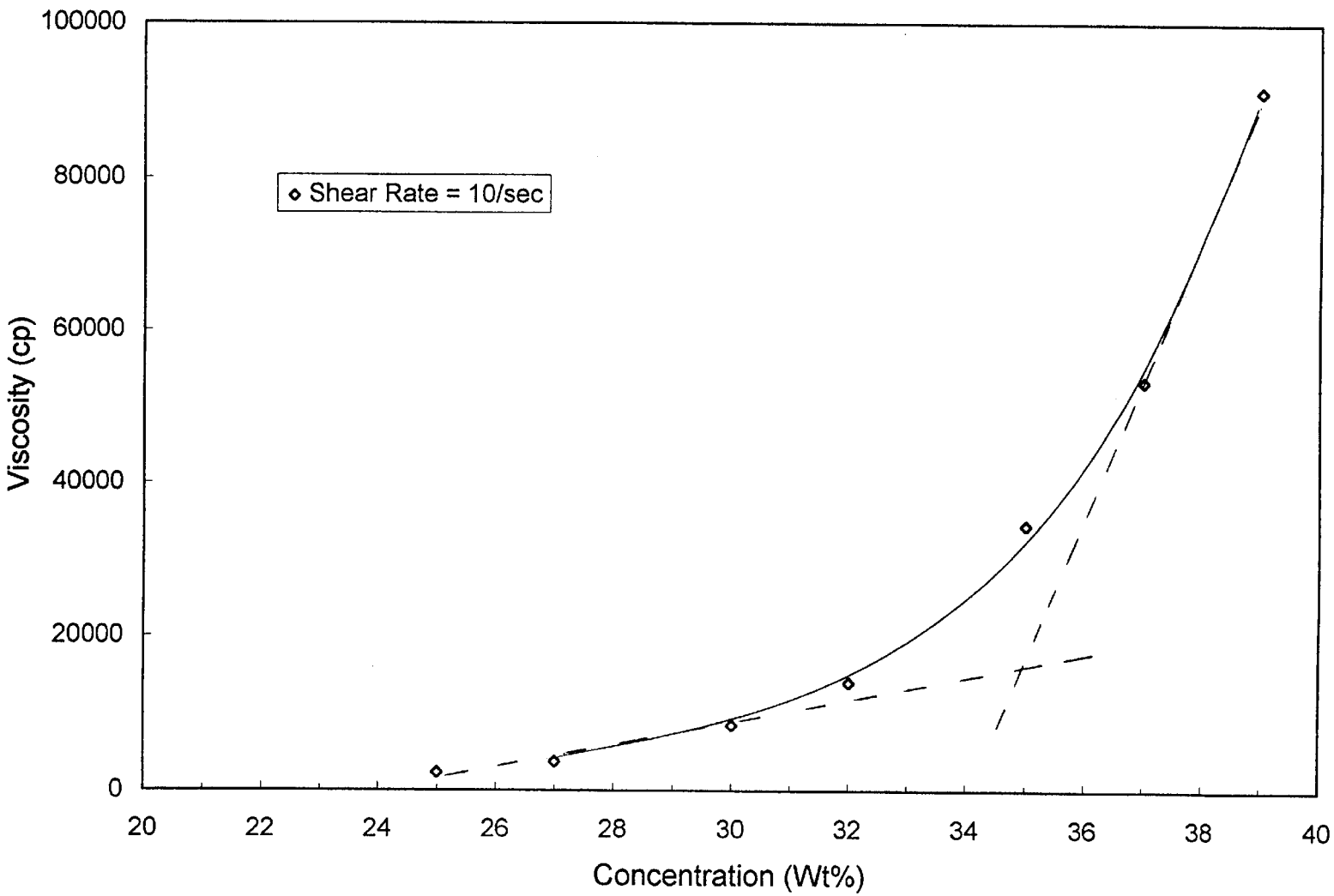
Figure 2: Viscosity vs. Concentration for 35/65 PES/NMP System

ULTRATHIN HIGH-PERFORMANCE HOLLOW FIBER MEMBRANES

References from the scientific and patent literature cited herein are hereby incorporated in their entirety by reference.

BACKGROUND OF THE INVENTION

This invention relates to the field of asymmetric hollow fibers, particularly those that comprise an ultrathin selective layer for air and gas separations.

In creating a gas or liquid separation membrane, it is desirable to have both a high rate of permeation or throughput and a high separation factor or selectivity. This combination of characteristics permits the effective separation of a relatively large volume of fluid per unit time. The phase inversion process is one of the most important means to prepare asymmetric membranes for air separation. The resultant membranes have a dense skin layer that is integrally bonded in series with a thick porous substructure. The skin and the substructure are composed of the same material.

The skin layer, which contains the effective separating layer, is one of the key elements in determining the membrane permeability and selectivity. To have a high-performance air-separation membrane, this skin layer has to be as thin as possible and must contain a minimum of defects.

U.S. Pat. No. 4,871,494 issued to Kesting, et al. describes a process for forming asymmetric gas separation membranes having graded density skins. This process comprises dissolving a glassy polymer in a Lewis acid: base complex solvent system wherein the Hildebrand parameters of the solvent species and the polymer are within 1.5. The spinning dope prepared by this method comprises a polymer and a solvent mixture, but the solvent mixture further contains two components.

U.S. Pat. No. 4,902,422 issued to Pinnau and Koros describes solution formulations to prepare defect-free ultra-high flux flat asymmetric membranes using a forced convective drying process. In order to form the skin layer, this process requires solvents which either have low boiling points or high vapor pressures in the solution system. The cast solution prepared by this method has multiple components, and at least consists of a polymer, a low boiling point solvent and a high boiling point solvent.

OBJECT OF THE INVENTION

It is an object of the present invention to provide an asymmetric hollow fiber membrane having both good selectivity and permeability for air and gas separations.

It is another object of the present invention to provide a method for improving the permeability of asymmetric hollow fiber membranes.

It is a further object of the present invention to provide a method for making highly permeable asymmetric hollow fiber membranes using biodegradable or environmental friendly solvents, such as NMP (N-methyl-2-pyrrolidone).

Other objects and advantages of the present invention will be apparent to those skilled in the art from the following description and the appended claims.

SUMMARY OF THE INVENTION

The invention is a semi-permeable asymmetric hollow fiber membrane comprising a glassy polymeric material with a porous inner layer and a dense external layer of less than 500 Å. After applying a silicone coating, the ultrathin dense layer can selectively separate one gaseous component from other gaseous components in a gas mixture. Both of the inner layer and dense external layer are comprised of the same material.

In another aspect, the invention is a process for preparing a semi-permeable hollow fiber membrane comprising:

A) dissolving a polymer possessing an equilibrium water content at about 25° C. of less than 2 w/w % in a solvent and forming, after continuous stirring, a homogeneous fluid, to be known as the spinning dope, possessing sufficient viscosity and exhibiting chain entanglement at the temperature at which the dope is to be spun;

B) extruding the said polymer-solvent solution through a spinneret (as shown in FIG. 1) into a hollow fiber membrane using water as an external coagulant and using a bore fluid having the following properties.

1. the solubility parameter difference between the bore fluid and the spinning dope is less than 2.5 $(cal/cm^3)^{0.5}$,
2. the volume ratio of bore-fluid flow rate to the dope flow rate is between 0.45 to 0.75;

C) immersing the spinneret in the water, both inner and external coagulations occurring simultaneously;

D) desolvating the asymmetric gas separation membrane thus formed through a water bath;

E) washing the membrane at ambient temperature in a polar medium; and

F) drying the membrane at temperatures of from about ambient to about 20° C. below the glass transition temperature.

The asymmetric hollow fiber membrane of this invention demonstrates surprisingly high gas separation factors and high gas permeabilities for the separation of at least one gaseous component from other gaseous components in a gas mixture. In particular, the membranes of this invention are useful for the separation of oxygen and nitrogen from air as well as for the separation of hydrogen from gas mixtures containing hydrogen. The asymmetric hollow fiber membrane of this invention has a selectivity above 90% of the inherent selectivity of the glass material.

BRIEF DESCRIPTION OF THE DRAWINGS

FIG. 1 is schematic diagram of the hollow fiber spinning apparatus

FIG. 2 is the solution viscosity of polyethersulfone (PES) in N-methyl-2-pytrolidone (NMP) measured at 25° C. using a Brookfield® cone-and-plate viscometer (Model: FIB DV-III). This viscosity data exhibits a visible chain entanglement phenomenon, shown by the rapid change in slope, at a concentration of about 35 wt %.

Figure 3A:
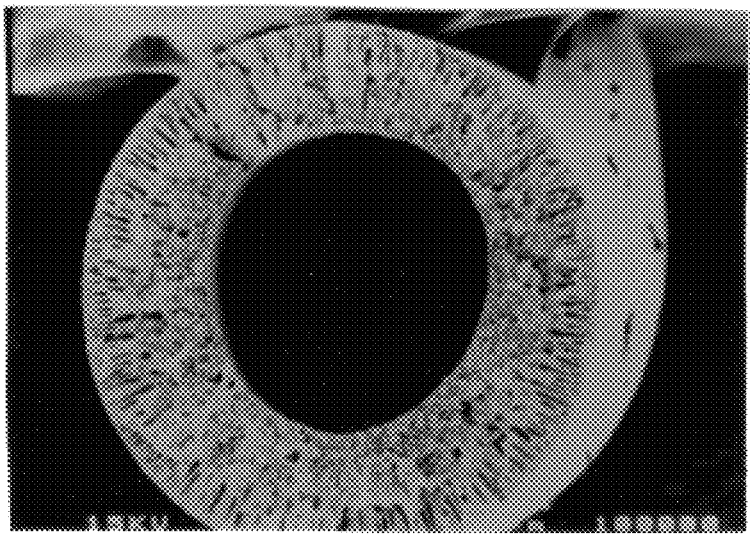
FIGS. 3A–3B show electron micrographs at magnifications of 50 (3A) and 750 (3B) of a cross-section of an ultrathin asymmetric hollow fiber membrane wet-spun from a 35% PES/NMP dope.

The accompanying drawings which are incorporated into and constitute a part of the description of the invention, illustrate the embodiments of the invention and serve to explain the principles of the invention. It is to be understood, however, that the drawings are designed for purposes of illustration only, and not as a definition of the limits of the invention for which reference should be made to the claims appearing at the end of the description.

DETAILED DESCRIPTION OF THE INVENTION

The invention resides in part in a process for forming ultrathin dense-layer asymmetric hollow fiber membranes. The process comprises in its most important aspect dissolving a polymer in a solvent to form a homogenous dope possessing sufficient viscosity and exhibiting chain entanglement at the spinning temperature. The dope is then extruded to form a hollow fiber membrane using water as an external coagulant and a bore fluid comprising with and a water miscible solvent. The solubility parameter difference between the bore fluid and the spinning dope is less than 2.5 $(cal/cm^3)^{0.5}$ and the volume ratio of bore-fluid flow rate to the dope flow rate ranges from 0.45 to 0.75.

After extrusion, the fiber is desolvated by allowing it to stand in a polar solvent, preferably water or methanol. A preferred desolvating process it to allow the fiber membrane to stand in the coagulating bath for some time, then washing it with methanol.

After the hollow fiber membrane is formed, it is preferably coated to seal surface defects. Preferably the fiber membrane is sealed by coating it with silicone by methods known in the art.

Preferred polymers for use in the process are selected from the group consisting of polyimide, a fluoropolymer, polysulfone, polyethersulfone, polyarylate, polycarbonate, a polybenzimidazole, polyetherketone, polyetherether ketone, and a polyester. Of fluoropolymers, the preferred one is a fluoropolyimide. Most preferably, the polymer is polyethersulfone.

The solvent for the dope is preferably a N-($C_1$–$C_3$ alkyl)-2-pyrolidone, most preferably N-methyl-2-pyrolidone.

The ratio of solvent to water in the bore fluid can range from 80/20 to 95/5, most preferably 80/20 to 90/10. The preferred solvent for the bore fluid is a N-($C_1$–$C_3$ alkyl)-2-pyrolidone, most preferably N-methyl-2-pyrolidone.

A preferred embodiment of the invention is one wherein the dope is 35/65 polyethersulfone/N-methyl-2-pyrolidone and the bore-fluid is 80/20 N-methyl-2-pyrolidone/water.

The invention further resides in hollow fiber membrane produced by the process; generally uncoated membranes will exhibit a selectivity characterized in that the $O_2/N_2$ selectivity is at least 0.96. Coating the membranes with silicone greatly increases the selectivity, generally by 5–6 fold. The membranes of the invention have excellent permeance; the permeance observed for $O_2$ is about $10.1\times10^{-6}$ cc(at Standard Temperature and Pressure)/$cm^2$-sec-cm Hg.

EXAMPLE 1

FIG. 1 is a schematic diagram of the hollow fiber spinning apparatus. FIG. 2 shows the viscosity of a PES/NES spinning dope as a function of PES solid concentration. This dope exhibits chain entanglement at 35/65 ratio of PES/NMP. A formulated 35/65 PES/NMP dope was therefore used in this example. This dope was fed under nitrogen pressure and an 80/20 NMP/water bore fluid was fed by a 500D Syringe Pump, made by ISCO. The accuracy of this ISCO precision pump was ±0.5% of the flow rate. The spinning dope and bore fluid met at the tip of the spinneret which was immersed in a water coagulation bath at 25° C. No nascent fibers were extended by drawing; the take-up velocity of the hollow fiber was nearly the same as the free falling velocity in the coagulation bath. After formation of the hollow fiber, the fibers were stored in the water bath for at least one day and then transferred to a tank containing fresh methanol for at least one hour to completely remove any residual NMP. Hollow fibers thus treated were used for further study. In the above process, the solubility parameter difference between the 80/20 NMP/$H_2O$ and 35/65 PES/NMP was 2.19 $(cal/cm^3)^{0.5}$ and the bore fluid rate was 0.1 cc/min. Other information relating to the process conditions and parameters are given in Table 1. Membrane samples for SEM study were first immersed in liquid nitrogen and fractured, and then sputtered with gold using a Jeol JFC-1100E Ion Sputtering Device. We employed a Jeol® JSM U3 electron microscope and a Hitachi® S-4100 field emission scanning electron microscope to investigate fiber morphology.

Two to five fibers with a length of 10 cm were assembled into modules. One end of the bundles was sealed with a 5-minute rapid solidifying epoxy resin (Araldite®, Switzerland), while the shell side of the other end was glued onto an aluminum holder using a regular epoxy resin (Eposet®). It took 8 hours to fully cure the Eposet® resin. The prepared module was fitted into a stainless steel pressure cell for the gas permeation measurement at 200 psi (13.6 bar).

The permeances, P/L, of gases through the hollow fiber module were determined using a bubble-flow meter and calculated using the following equation:

$$\frac{P}{L} = \frac{Q}{\Delta PA} = \frac{Q}{n\pi Dt\Delta P} \tag{1}$$

where P=permeability of the separation layer;

t=effective length of the fibers;

ΔP=transmembrane pressure drop;

A=membrane effective surface area;

Q=the gas flux reading;

n=number of tested fibers;

D=outer diameter of the fibers.

We use GPU as the gas permeation units, and one GPU is equal to $1\times10^{-6}$ $cm^3$ (STP)/cm2-sec-cm Hg. The ideal separation factor of an asymmetric membrane can be determined from:

$$\alpha = \frac{\left(\frac{P}{L}\right)_A}{\left(\frac{P}{L}\right)_B} \tag{2}$$

where $_A$ and $_B$ denote different gases.

The effective skin layer thickness is estimated from the oxygen permeability and the pressure-normalized flux of oxygen from the following equation:

$$L = \frac{P_{O_2}}{(P/L)_{O_2}} \quad (3)$$

$P_{O_2}$ in equation (3) is the permeability of $O_2$ in the material.

$(P/L)_{O_2}$ is calculated as in equation (1).

L is the effective skin layer thickness.

The selectivities of polyethersulfone (PES) for $O_2/N_2$ can be, for instance, 6.1 with a permeability of 0.51 Barrer at 30° C., or 5.1 with a permeability of 0.81 Barrer at 50° C. In addition, one may calculate permeability of $O_2$ at 25° C., which maybe about 0.44 Barrer by using an Arrhenius relationship between permeability and temperature. Oxygen permeability is further described in Journal of Membrane Science 133 (1997) 161–175, which is incorporated by reference herein.

Assembled hollow fiber modules were further immersed in a coating solution containing 3 wt % polydimethysiloxane (Sylgard-184) in n-hexane for 5 minutes in order to seal the membrane defects. The coated fiber membrane module was left to stand for 48 hours to cure the silicone rubber coating at room temperature before conducting permeation tests.

Figure 3B:
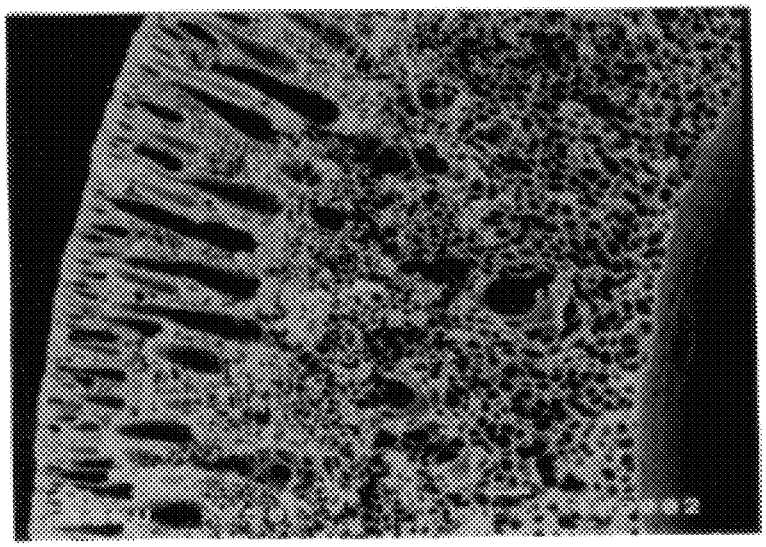
Figure 4:
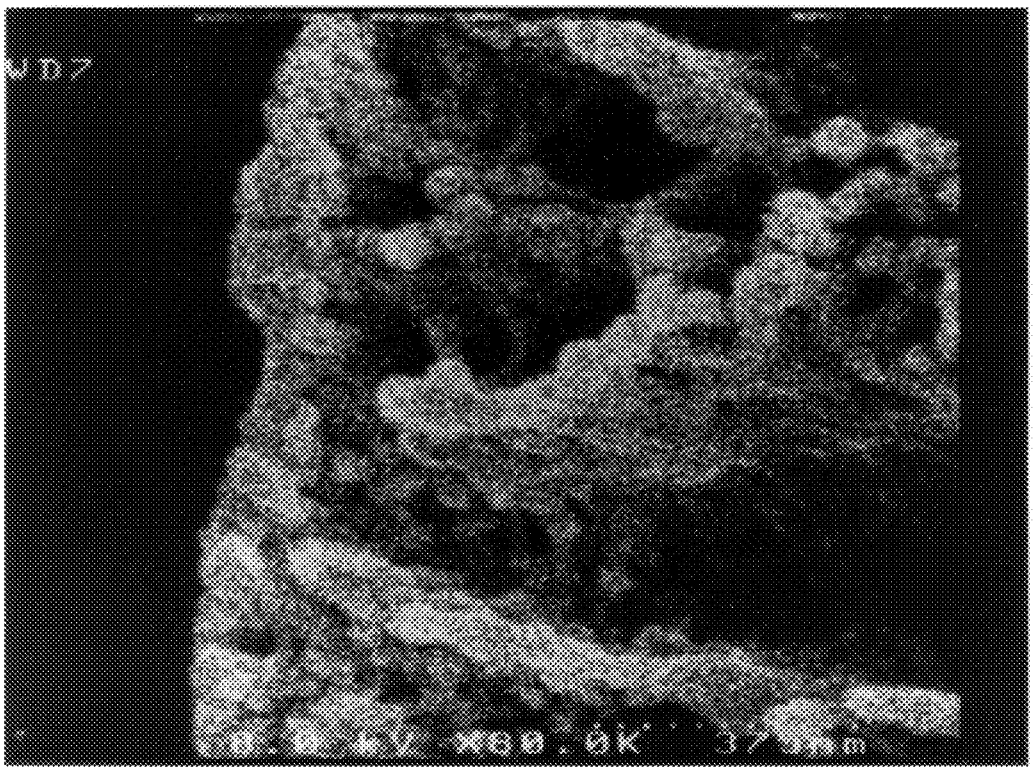
FIG. 4 is an electron micrograph at a magnification of 80,000 of a cross-section near the outer skin of an ultrathin asymmetric hollow fiber membrane wet-spun from a 35% PES/NMP dope.
Figure 5:
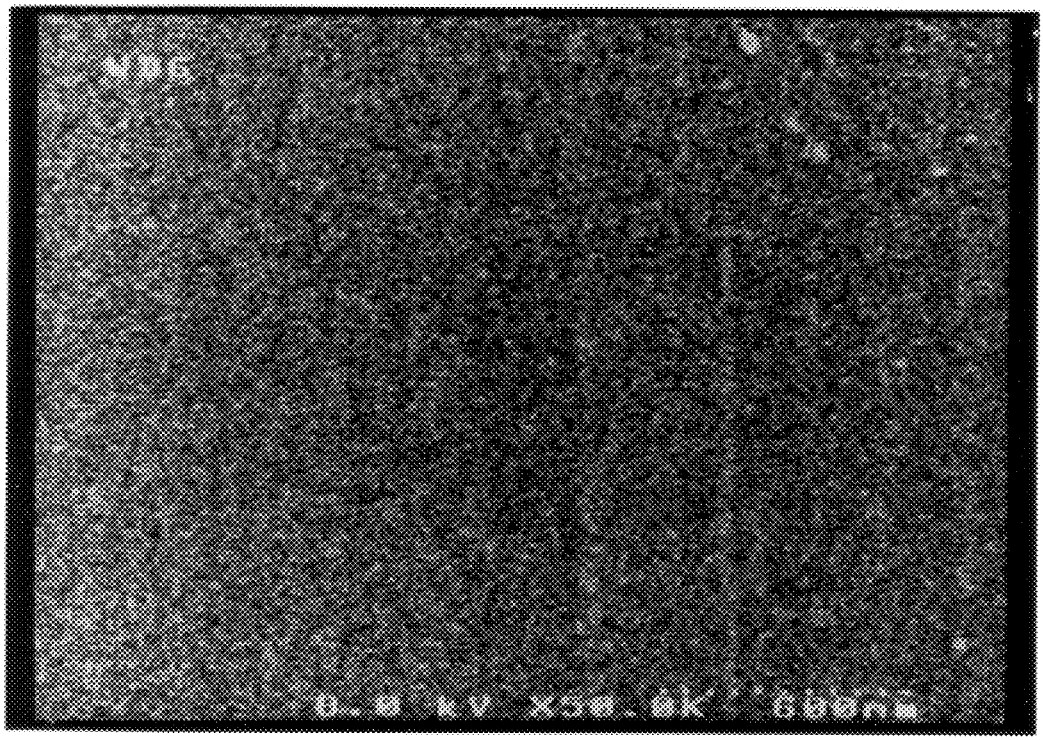
FIG. 5 is a scanning electron micrograph (SEM) at a magnification of 50,000 of the outer skin of an ultrathin asymmetric hollow fiber-membrane wet-spun from a 35% PES/NMP dope.
Figure 6A:
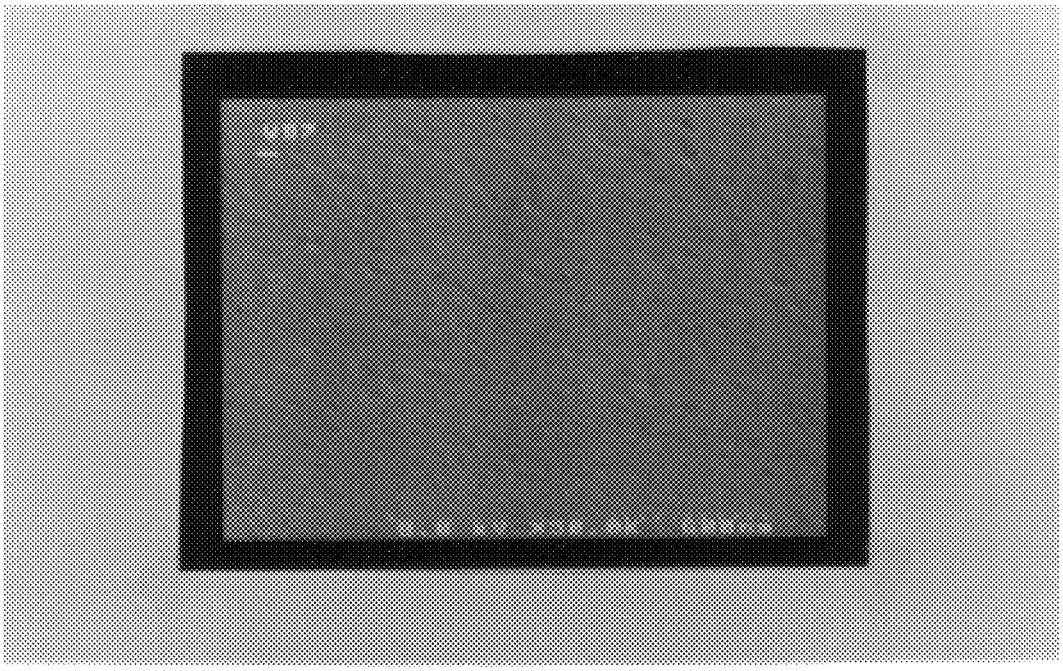
FIGS. 6A–6B show electron micrographs at a magnification of 50,000 of the outer skin of asymmetric hollow fiber membranes dry-jet wet-spun (6A) and wet-spun (6B) from a 30% PES/NMP dope.
Figure 6B:
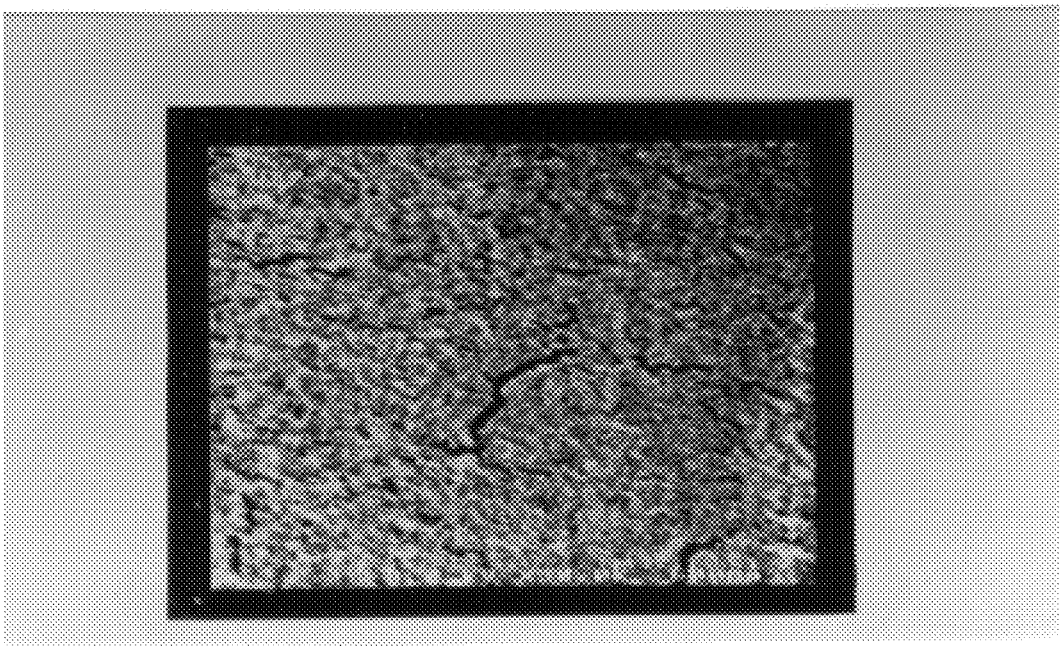

Table 4 summarizes the separation performance of the hollow fiber for air separation at 25° C. The uncoated fiber has an $O_2/N_2$ selectivity of about 0.96 and this value is significantly improved to 5.80 after a silicone coating. The invented fiber has a permeance of $10.13\times10^{-6}$ cc(STP)/cm$^2$-sec-cm Hg for $O_2$ at room temperature and the calculated dense layer thickness is 434 Å using Eq. 3. (STP, standard temperature and pressure). FIGS. 3A and 3B depict SEM pictures of the fiber cross-section and show that the region near the inner surface exhibits of no finger-like voids and no dense layer. FIG. 4 illustrates the detailed structure near the outer layer at a magnification of 80,000 and indicates this layer consists of nodules. The outermost skin has a thickness of approximately 600–800 Å and the substructure beneath the outermost skin is quite porous and has a tiny finger-like structure. Since the gold coating thickness on SEM samples is around 100–150 Å, this SEM picture suggests that the selective layer should be less than 600 Å. FIG. 5 reveals the outer surface morphology and shows no visible defects.

EXAMPLE 2

Except the bore fluid concentration, air-gap distance and flow rate, all other process conditions are substantially the same as in Example 1. The bore fluid in this example is 60/140 NMP/water and the bore fluid rate is 0.05 cc/min. The solubility parameter difference between the 60/40 NMP/$H_2O$ and 65/35 PES/NMP is 4.63 (cal/cm$^3$)$^{0.5}$. Other information process conditions and parameters are given in Table 1.

Table 3 compares gas separation performance of as-spun fibers before and after the silicone rubber coating and both show poor separation performance. Before silicone coating, wet-spun and dry-jet wet-spun fibers have $O_2/N_2$ selectivities in the range of 0.93 to 0.96. After coating, the wet-spun fibers have a slightly better $O_2/N_2$ selectivity than that of the dry-jet wet-spun fibers. However, both have selectivities well below 90% of the inherent selectivity of PES.

EXAMPLE 3

A formulated 30/70 PES/NMP dope was used as the spinning dope and a 40/60 NMP/water mixture was used as bore fluid. The dope viscosity is 8,493 cp which is below the critical viscosity of approximately 34,000 cp. Other information about process conditions and parameters are given in Table 1. The solubility parameter difference between the 40/60 NMP/$H_2O$ and 30/70 PES/NMP is 6.83 (cal/cm$^3$)$^{0.5}$. Table 3 compares gas separation performance of as-spun fibers before and after the silicone rubber coating and both show poor separation performance. FIG. 5 shows the SEM pictures of external surface of these fibers at 50,000 magnification. Both fibers have visible defects in their external skins.

TABLE 1

Process Parameters and Spinning conditions for 30 and 35 wt % PES/NMP Dopes.

| ID | Example 3 | Example 2 | Example 1 |
|---|---|---|---|
| Polymer concentration PES/NMP (by | 30% | 35% | 35% |
| Viscosity (poise) at 10 sec$^{-1}$ | 8493 | 34,444 | 34,444 |
| Dope pressure, psi | 10 | 25 | 25 |
| Dope fluid rate, gram/min | 0.32 | 0.234 | 0.216 |
| Spinning speed, cm/min | 81 | 41.4 | 67.8 |
| Spinning temperature, ° C. | 25 | 25 | 25 |
| Bore fluid composition (NMP/$H^2O$ by weight) | 40/60 | 60/40 | 80/20 |
| Bore fluid flow rate (cc/min) | 0.083 | 0.05 | 0.1 |
| External coagulant | Water | Water | Water |
| Coagulation bath temperature ° C. | 25 | 25 | 25 |

TABLE 2

Permeance of PES Wet-spun fibers (spun from 35 wt % PES/NMP dopes using 80/20 NMP/$H_2O$ as the bore fluid)

| | $O_2$ permeance | $N_2$ permeance | Selectivity $O_2/N_2$ |
|---|---|---|---|
| Before Silicone | 258.42 | 269.19 | 0.96 |
| After Silicone | 10.13 | 1.746 | 5.80 |

TABLE 3

Permeance of wet-spun (0 air gap) and dry-jet wet-spun hollow fibers (spun from 35 wt % PES/NMP dopes using 60/40 NMP/$H_2O$ as the bore fluid)

| Air gap distance | $O_2$ permeance | $N_2$ permeance | Selectivity $O_2/N_2$ |
|---|---|---|---|
| A: Before Silicone Coating | | | |
| 6.0 | 68 | 71 | 0.96 |
| 0 | 28 | 30 | 0.93 |
| B: After Silicone Coating | | | |
| 6.0 | 36 | 37 | 0.97 |
| 0 | 15.9 | 6.33 | 2.51 |

TABLE 4

Permeance of Wet-spun (0 air gap) and dry-jet wet-spun hollow fibers (spun from 30 wt % PES/NMP dopes using 40/60 NMP/$H_2O$ as the bore fluid)

| Air gap distance | $O_2$ permeance | $N_2$ permeance | Selectivity $O_2/N_2$ |
|---|---|---|---|
| A: Before Silicone Coating | | | |
| 14.4 | 22.87 | 25.23 | 0.91 |
| 0 | 75.79 | 74.9 | 0.99 |
| B: After Silicone Coating | | | |
| 6.0 | 12.8 | 13.5 | 0.95 |
| 0 | 15.0 | 6.1 | 2.38 |

What is claimed is:

1. A process for forming ultrathin dense-layer asymmetric hollow fiber membranes comprising a) dissolving a polymer in a solvent to form a homogenous dope possessing sufficient viscosity and exhibiting chain entanglement at the spinning temperature;

b) extruding the mixture to form an asymmetric hollow fiber membrane using water as an external coagulant and a bore fluid comprising water and a water miscible solvent; wherein the solubility parameter difference between the bore fluid and the spinning dope is less than 2.5 $(cal/cm^3)^{0.5}$, and the volume ratio of bore-fluid flow rate to the dope flow rate ranges from 0.45 to 0.75.

2. The process according to claim 1 wherein the polymer is selected from the group consisting of polyimide, a fluoropolymer, polysulfone, polyethersulfone, polyarylate, polycarbonate, a polybenzimidazole, polyetherketone, polyetherether ketone, and polyester.

3. The process of claim 2, wherein the polymer is polyethersulfone or a fluoropolyimide.

4. The process of claim 2, wherein the polymer is polyethersulfone.

5. The process of claim 1, wherein the solvent in a N-($C_1$–$C_3$ alkyl)-2-pyrolidone.

6. The process of claim 1, wherein the solvent is N-methyl-2-pyrolidone.

7. The process of claim 1, wherein the dope is 35/65 polyethersulfone/N-methyl-2-pyrolidone.

8. The process of claim 1, wherein the bore-fluid is 80/20 to 95/5 N-methyl-2-pyrolidone/water.

9. The process of claim 6, wherein the bore-fluid is 80/20 N-methyl-2-pyrolidone/water.

10. The process of claim 7, wherein the bore-fluid is 80/20 N-methyl-2-pyrolidone/water.

11. The process of claim 1 further comprising c) coating the hollow fiber membrane with silicone.

12. The process of claim 9, further, comprising c) coating the hollow fiber membrane with silicone.

13. The process of claim 10, further comprising c) coating the hollow fiber membrane with silicone.

* * * * *